US005857418A

United States Patent [19]

Pulec et al.

[11] Patent Number: 5,857,418

[45] Date of Patent: Jan. 12, 1999

[54] DEVICE FOR STORING VALUABLE OBJECTS

[75] Inventors: Zbyněk Pulec; Michal Vondra; Jaromír Grygera, all of Prague, Czechoslovakia

[73] Assignee: Pulec Holding, A.S., Praha, Czechoslovakia

[21] Appl. No.: 615,415

[22] Filed: Mar. 14, 1996

[30] Foreign Application Priority Data

Apr. 20, 1995 [CS] Czechoslovakia ..... 1023-95

[51] Int. Cl.[6] ..... E05G 1/00

[52] U.S. Cl. ..... 109/56; 109/53; 70/277

[58] Field of Search ..... 109/50, 52, 53, 109/56, 74, 79; 70/277; 340/825.31; 312/217, 222

[56] References Cited

U.S. PATENT DOCUMENTS

| | | | |
|---|---|---|---|
| 2,585,919 | 2/1952 | Davis | 109/53 X |
| 3,837,299 | 9/1974 | McClellan | 109/53 X |
| 3,837,300 | 9/1974 | Karr | 109/53 X |
| 4,557,201 | 12/1985 | Webb, Jr. | 109/53 X |
| 4,608,932 | 9/1986 | Bohland et al. | 109/53 X |
| 4,648,550 | 3/1987 | Cleary, Jr. | 109/56 X |
| 5,206,637 | 4/1993 | Warren | 70/277 X |
| 5,219,386 | 6/1993 | Kletzmaier et la. | 70/277 |
| 5,385,039 | 1/1995 | Feldpausch et al. | 70/277 X |
| 5,435,255 | 7/1995 | Elseser et al. | 109/56 |
| 5,504,325 | 4/1996 | Talmon et al. | 109/56 X |

*Primary Examiner*—Suzanne Dino Barrett
*Attorney, Agent, or Firm*—Morrison & Foerster LLP

[57] ABSTRACT

A device for storing valuable objects, money in vaults in particular, comprising containers (5; 6; 7; 8) located separately of one another and on undercarriages (2), which may be adjustably rearranged on rails (1) in a vault, wherein each such container (5; 6; 7; 8) is equipped on the top thereof with at least two centering projections (3) and/or hollows (4), and on the bottom thereof with corresponding projections (3) and/or hollows (4), while each such undercarriage (2) has located on its top surface corresponding centering projections (3) and/or hollows (4) to rectify the containers (5; 6; 7; 8). Such containers (5; 6; 7; 8) are equipped with upper interconnecting contacts (9) and lower interconnecting contacts (10), while such upper interconnecting contacts (9), located on the top surface of each container (5,6,7,8), are connected to the follower unit (11) that is positioned in each such undercarriage (2). Each such container (5; 6; 7; 8) is equipped with an identification unit (12) with an input (13) for the contact unit (14), and each such identification unit (12) is connected to a line between the upper and the lower interconnecting contacts (9, 10), respectively, of such container (5; 6; 7; 8), while all follower units (11) are connected to the control unit (16) by means of the data line (15).

11 Claims, 5 Drawing Sheets

DEVICE FOR STORING VALUABLE OBJECTS

FIELD OF THE INVENTION

The present invention relates to devices for storing valuable objects, such as money, in vaults.

BACKGROUND OF THE INVENTION

To store money in large vault rooms of banks, various transportable bins and containers are used, which are stored in racks, cases or directly on the floor of the vaults.

From U.S. Pat. No. 4,423,687, safe deposit boxes are known, which are grouped in nests. Each nest is provided with pluralities of retainer brackets mounted along the upper and lower edges of the rear wall of the nest. The retainer brackets are configured with a central portion that is spaced away from the nest wall to define a vertically opening passageway. The retainer brackets along the lower edge of an overlying nest may then be aligned with the retainer bracket along the upper edge of an underlying nest by bringing the two nests into precise registration. A locking member is then passed through each aligned pair of retainer brackets.

GB 2 270 067 shows stackable trays with means for forming a stack, the members of which can be either directly in vertical juxtaposition or vertically spaced apart by spacers, or staggered horizontally, or a combination of these.

DE 34 09 127 describes lockable boxes, which can be put on one another to form a plurality of segments. The segments are located one by one on rails on the floor so that by rearranging all segments, a gap may be formed between two adjacent segments.

A disadvantage of such known arrangements, in addition to non-economical utilization of the vault room and complicated handling, is that it is difficult to record the content and locations of the containers. These known arrangements require that every container be placed at a location determined in advance, and that updated records be continuously kept.

SUMMARY OF THE INVENTION

The above mentioned drawbacks may be eliminated by a device for storing valuable objects, for example money, in vaults, comprising containers located separately on one another and on undercarriages, which may be adjustably rearranged on rails in a vault. Each container is equipped on the top surface thereof with at least two centering projections and/or hollows, and on the bottom surface thereof with corresponding projections and/or hollows. Located on the top surface of each undercarriage are corresponding centering projections and/or hollows to rectify the containers. The containers are equipped with upper interconnecting contacts and lower interconnecting contacts. The upper and lower interconnecting contacts then connect to a follower unit, positioned in each undercarriage, through an additional upper connecting contact that is located at the top surface of each undercarriage, and each such container is equipped with the identification unit with input for a contact unit. Each identification unit is connected to a line between the upper and the lower interconnecting contacts, respectively, of its respective container. All follower units are connected to the control unit by means of a data line.

This arrangement of equipment makes it possible to easily locate in which room of a vault a particular container is situated in, which undercarriage it is currently deposited on (specifically, in which column and at which position in a column), and can further signal which of the containers has been opened. The identification unit of each container may keep information on the container's number, the value of banknotes or coins in the container, the exact number of banknotes or coins therein, the total nominal value of items in each said container, the names and passwords of the persons having carried out the last handling of money, including time and date of such handling, or other items of information.

According to the practice of the present invention, owing to a system of centering projections, and hollows and interconnecting contacts, information on the current position of the containers is automatically updated during any relocation of a container, which may be continuously monitored by operators on a display of the control unit where, of course, data transmitted by identification units may also be displayed. Thus the operators may have comprehensive information available on the moment-by-moment status of the vault and its contents.

The devices to the invention therefore make possible a perfect utilization of the internal space in a vault,while at the same time facilitating handling the stored containers.

It is advantageous for each undercarriage to have its own drive.

A favorable shape for the centering projections is a cone.

Dependent upon the particular type of valuable objects to be stored, it is advantageous if the containers are coin containers and/or bank containers and/or of shelf racks and/or shelf boxes, while all containers are equipped with shoulders to be gripped by a fork of a high lift truck.

A favorable arrangement of such coin containers and such bank note containers has a frame of angle irons covered with a case of sheet metal with a front door, and an upper door with a joint control comprising at least of one lever, rotatingly positioned on the front door pin. The trajectory of the end point of the lever arm both passes through the opening in the frame, and engages jointly with a blocking mechanism of the upper door.

According to another advantageous arrangement, the follower unit consists of a single chip microcomputer, the identification unit consists of a transponder with programmable memory, and the control unit consists of a PC.

BRIEF DESCRIPTION OF THE DRAWINGS

The invention may be further exemplified using drawings which show particular arrangements of the devices of the invention. The drawings are as follows.

DESCRIPTION OF THE PREFERRED EMBODIMENTS

Figure 8:
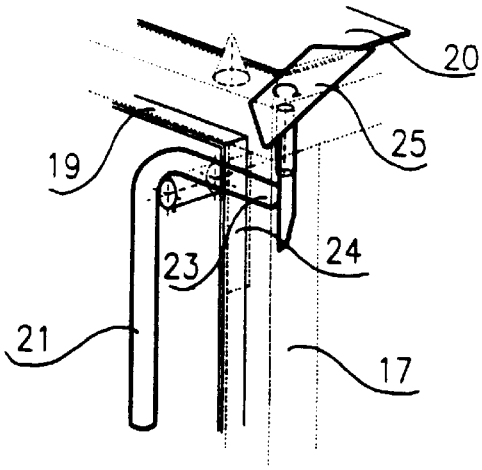
FIG. 8 depicts joint control of the front and upper doors of coin and bank containers in the "closed" position.
Figure 9:
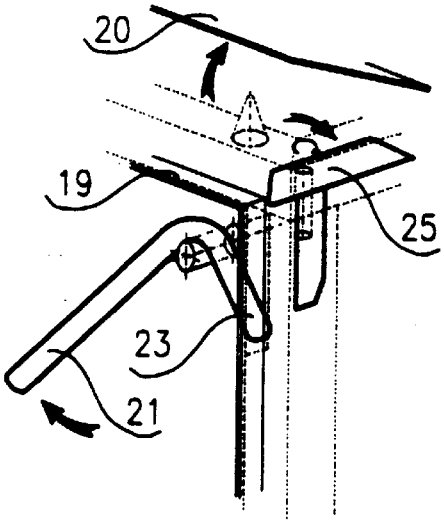
FIG. 9 depicts the control of FIG. 8 in the "upper door opened" position.
Figure 10:
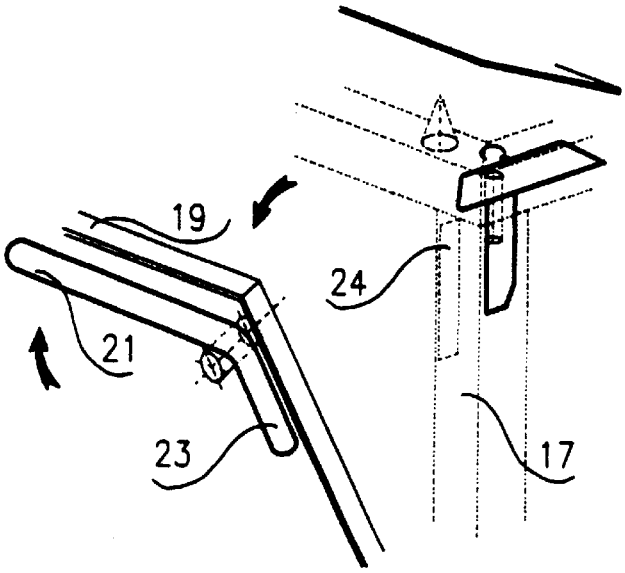
FIG. 10 depicts the control of FIGS. 8 and 9 in the "both doors opened" position.

According to the practice of the present invention, a device for storing valuable objects consists of containers, which are selected, according to the type of objects stored. Such containers include coin containers 5, bank containers 6, shelf racks 7, shelf boxes 8, and other types of containers. The coin containers 5 and bank containers 6 comprise a frame 17 of angle iron, which is covered with a case of metal sheet 18, there being also a front door 19, and an upper door 20, with a joint control comprising a pair of levers 21 located on the opposite sides of the containers. Each lever 21 (see FIGS. 8–10) is rotatingly positioned at pin 22 of the front door 19 so that the trajectory of the end point of arm 23 of the lever 21 both passes through opening 24 in the frame 17, and engages jointly with the blocking mechanism 25 of the upper door 20. The containers 5; 6; 7; 8 are located on the undercarriages 2, while, of course, various types of containers 5; 6; 7; 8 may be combined on a single undercarriage 2. All containers are equipped on the top with a pair of centering projections 3 of a conical shape and with a symmetrically located pair of hollows 4 on the bottom. The hollows consist of round holes, the diameter of which corresponds to the maximum diameter of the conical centering projections 3.

Conical centering projections 3 are also located on the upper surface of each undercarriage 2. Each undercarriage 2 is equipped with its own drive 26 comprising an electric motor installed in the undercarriage with its own movable power supply. The undercarriages 2 are located one by one on rails I on the vault floor so that by rearranging all undercarriages 2, a gap for a high lift truck may be formed between two adjacent undercarriages.

The containers 5; 6; 7; 8 are deposited on the undercarriages 2 in two rows of four columns, that is, eight columns of the containers altogether on a single undercarriage 2.

The position of the individual columns of the containers 5; 6; 7; 8 on the undercarriage 2 is determined in advance by the position of the centering projections 3, which also rectify the individual containers against one another (see FIGS. 1–4).

All containers 5; 6; 7; 8 have upper interconnecting contacts 9 and lower interconnecting contacts 10, with upper interconnecting contacts 9 also being located on the top surface of each undercarriage 2. Each container 5; 6; 7; 8 (see FIG. 7) is equipped with an identification unit 12 that is connected to a line between the upper interconnecting contact 9 and the lower interconnecting contact 10 of said containers 5; 6; 7; 8.

Figure 1:
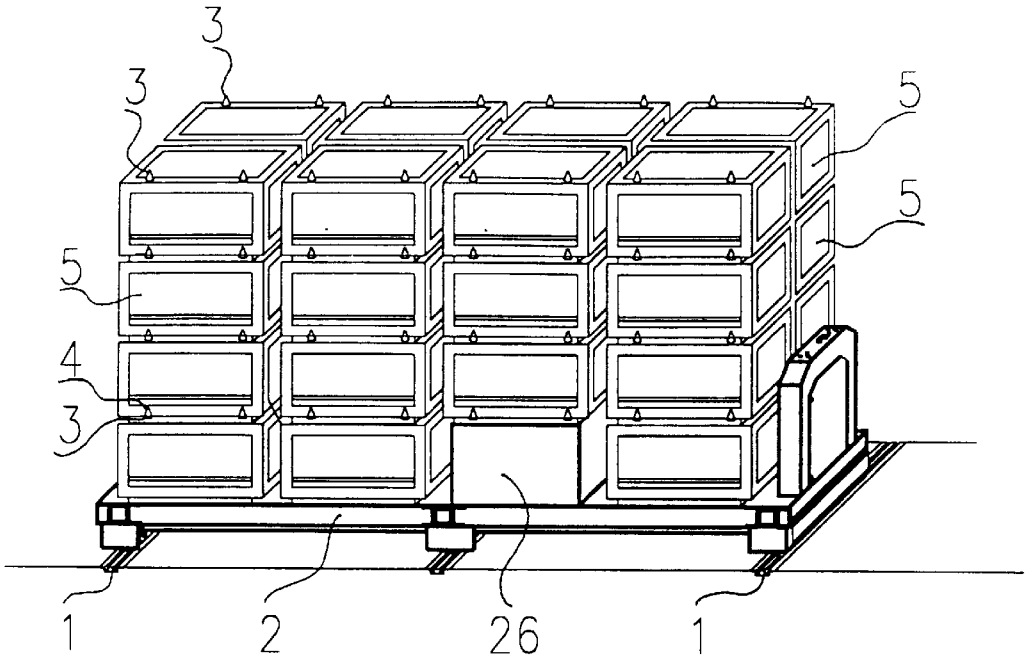
FIG. 1 shows an undercarriage on a rail in a vault, on which coin containers are seated.
Figure 2:
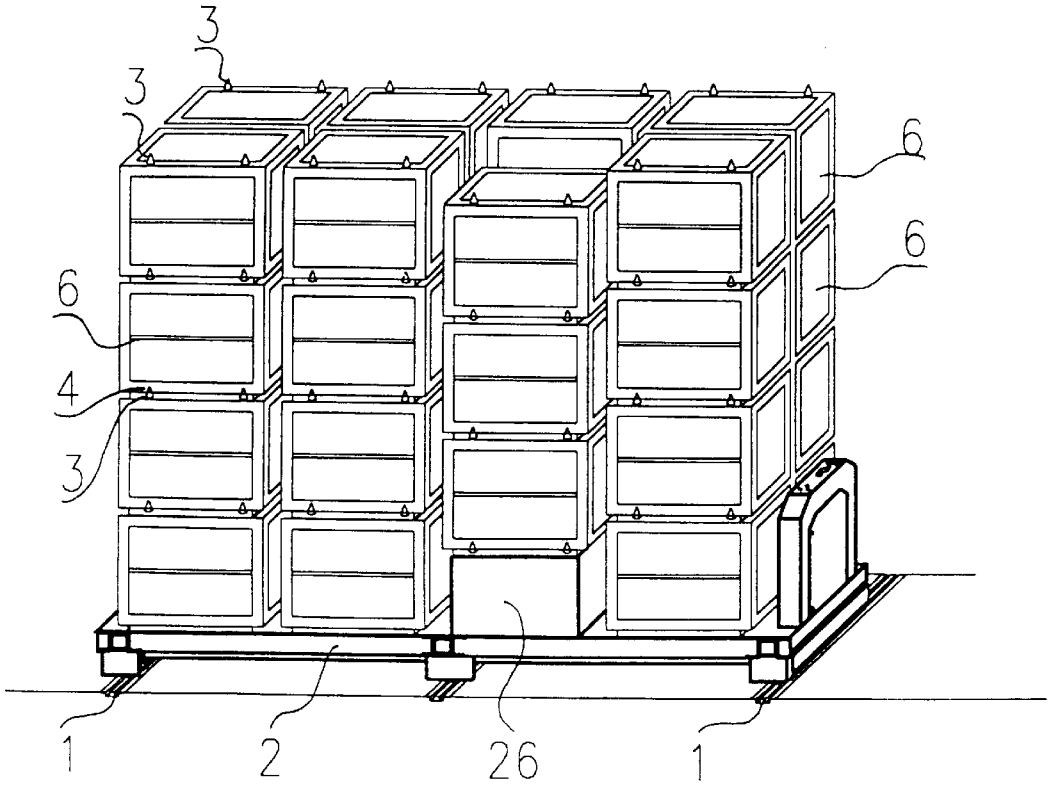
FIG. 2 shows an undercarriage with bank containers.
Figure 3:
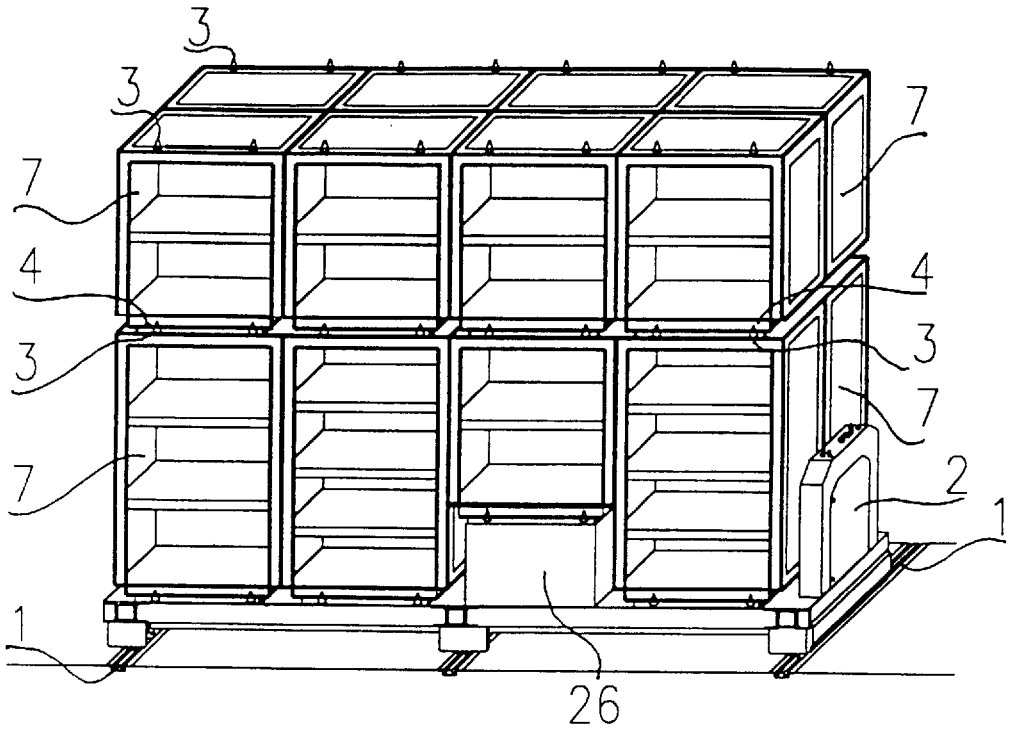
FIG. 3 shows an undercarriage with shelf racks.
Figure 4:
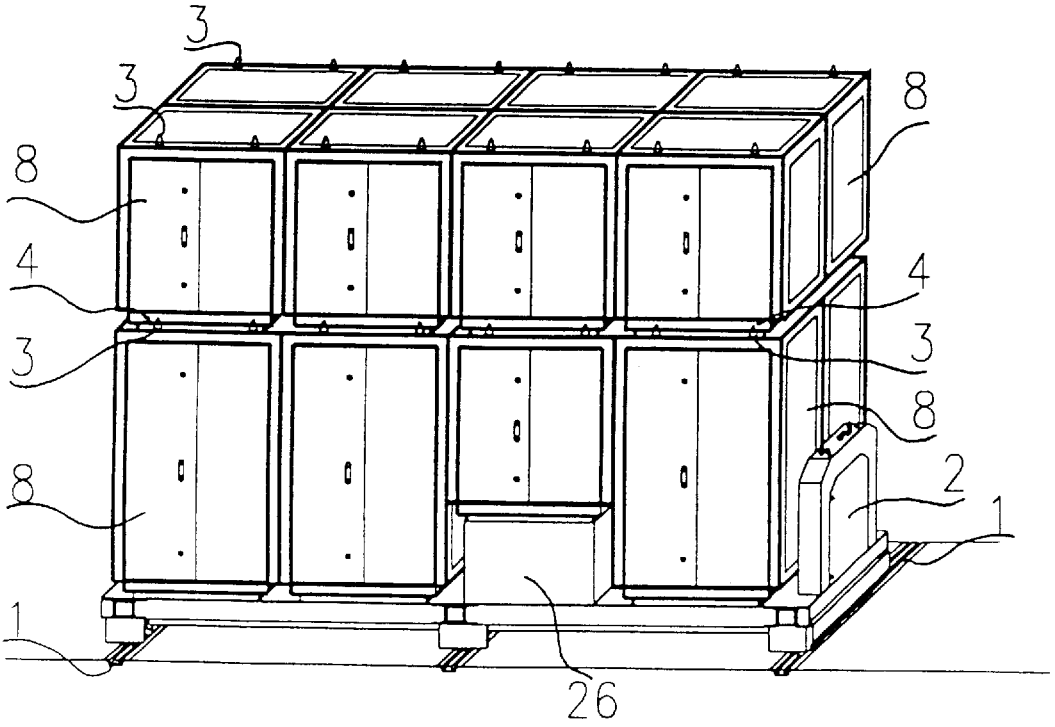
FIG. 4 shows an undercarriage with shelf boxes.
Figure 5:
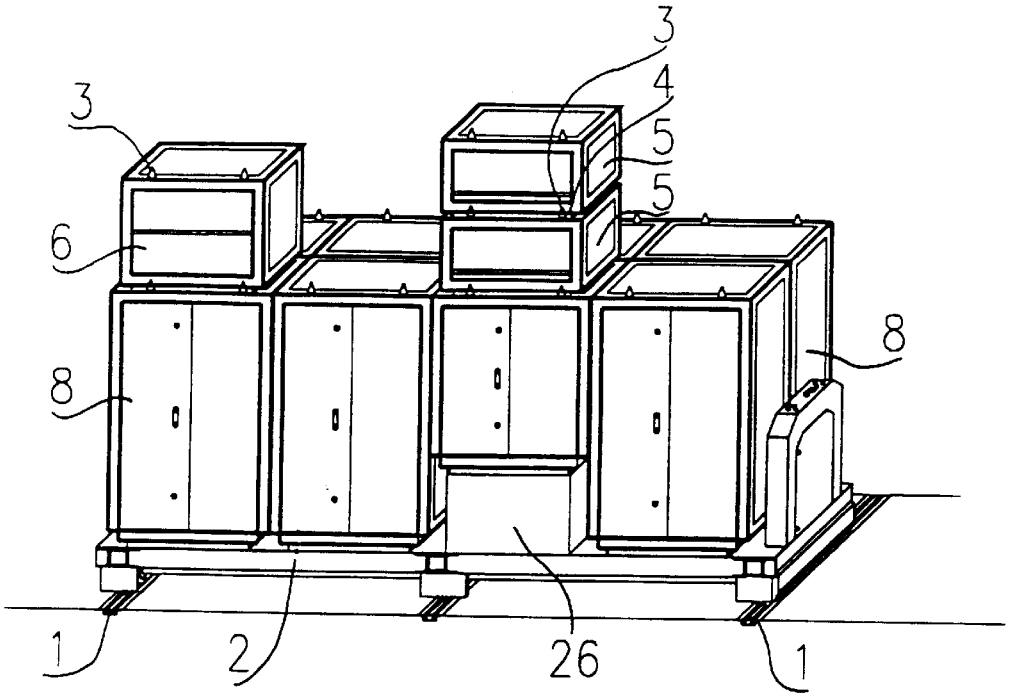
FIG. 5 shows an undercarriage with shelf boxes and coin containers.
Figure 6:
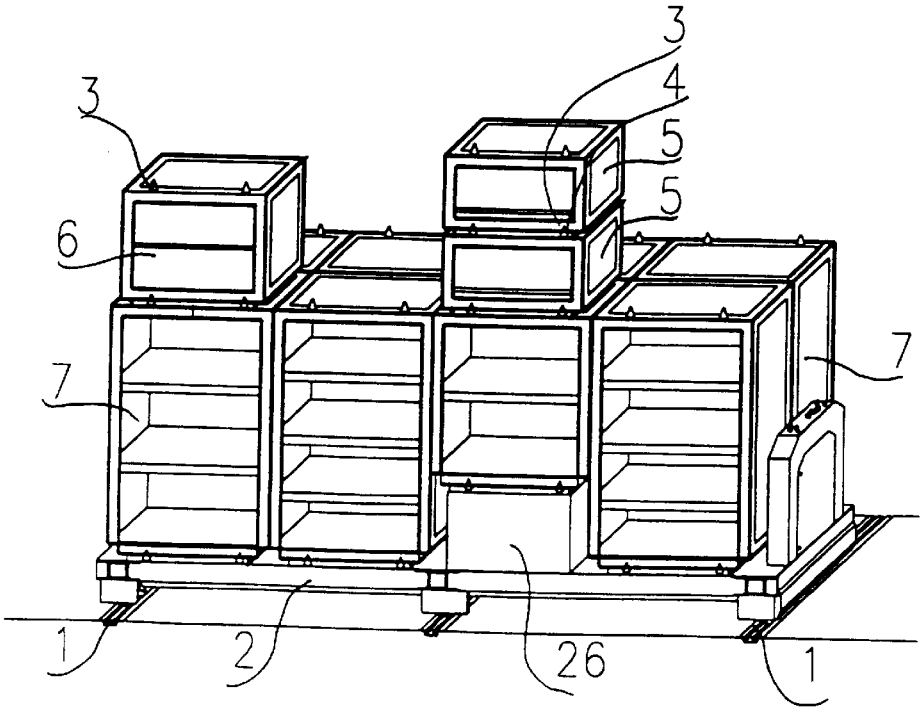
FIG. 6 shows an undercarriage with shelf racks and coin containers.
Figure 7:
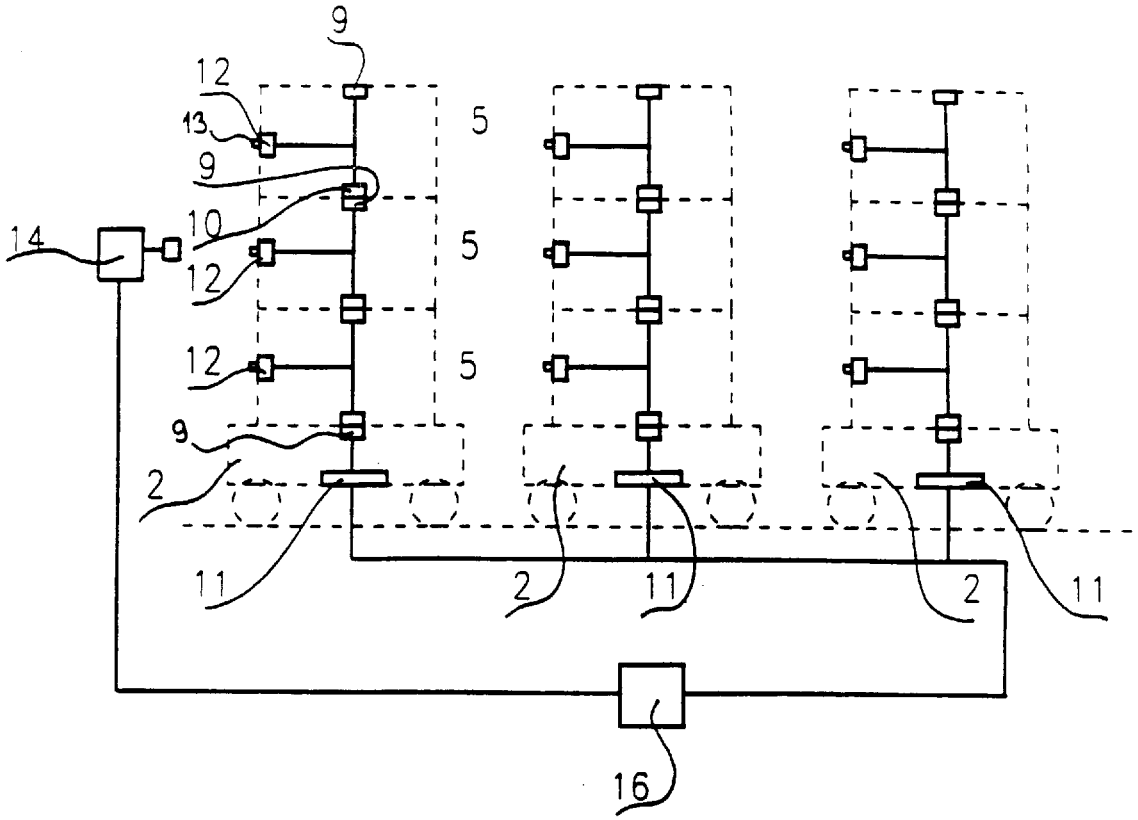
FIG. 7 is a diagrammatic presentation of a device to the invention supplemented with a connection for locating the containers.

The identification unit 12 consists of a transponder with a programmable memory, and also the input 13 for the contact unit 14 (FIG. 7).

The contact unit 14 may be connected by means of a cable to control unit 16 (see FIG. 7).

Each undercarriage 2 is equipped with a follower unit 11 that comprises a single chip microcomputer, which unit is connected to the upper interconnecting contacts 9 that are arranged on the top surface of the undercarriage 2.

The follower units 11 of all undercarriages 2 are connected to control unit 16, comprising a PC/486 computer, via data line 15, for example of a RS-485.

Both the follower units 11 and the identification units 12 are designed as compact units, the electronic section of each being installed inside the metal frames, and are thus resistant to mechanical damage during handling of the undercarriages 2, and the containers 5; 6; 7; 8.

Data transmission between the control unit 16 and follower units 11 on an undercarriage 2 is provided by data line 15, although in the case of vault installation with the undercarriages mounted on rails, the distribution of data is provided by means of lines in cable strips. In this case, positions are provided on undercarriages 2 for connection boxes located at the distribution strips, from which a movable connection can be provided between the wall and the appropriate undercarriage 2.

To record data from the identification unit 12 of each container 5; 6; 7; 8, the contact unit 14 is connected to the input 13 of the identification unit 12, and is then connected to control unit 16. As a result, in addition to the identification number, information may be recorded from an identification unit 12 concerning the respective container's content and also data on its handling.

After placement of containers 5; 6; 7; 8 at certain positions on an undercarriage 2, first a rectification of the containers takes place using the system of centering projections 3 and hollows 4 thereby connecting the upper and lower connecting contacts 9 and 10 respectively, and thus connection is made as to all identification units 12 of the containers 5; 6; 7; 8 on this undercarriage 2 with the follower unit 11 thereof. Then, via data line 15, the follower units 11 of all undercarriages 2 become connected to the control unit 16.

Since the identification unit 12 of each container 5; 6; 7; 8 transmits its identification number and other recorded data to the control unit 16 after being placed at any position on any undercarriage 2, the operator can instantly identify on the display of the control unit 16 the position in the vault of the container 5; 6; 7; 8 that is looked for. Of course, the operator also has other data available to him/her so that he/she can continuously monitor the occupancy of the undercarriages 2, or locate any container by its identification number or its content, or monitor handling of the containers 5; 6; 7; 8.

Information on the container positions is automatically updated, the other data may be updated after connecting the contact unit 14 to the appropriate identification unit 12. Only authorized persons are allowed to handle the contact unit 14.

When opening coin containers 5 or bank containers 6, the blocking mechanism 25 of the upper door 20 is first released by turning lever 21 to a first position, while front door 19 remains closed. Only after lever 21 is turned to a second position, at which point the end of arm 23 of said lever 21 clears the opening 24 in said frame 17, may front door 19 be opened.

Accordingly, devices according to the invention may be utilized when equipping the inner rooms of large bank vaults, where an economical utilization of built-up area is required, and also provide for the possibility of automatically locating the position of, and also monitoring the content of, containers with valuable objects.

We claim:

1. A device for storing objects that comprises containers (5; 6; 7; 8) placed on one another and then on undercarriages (2) that may be adjustably rearranged on rails (1) on a surface, wherein each said container (5; 6; 7; 8) is equipped on the top with at least two centering projections (3) and/or hollows (4), and on the bottom with corresponding projections (3) and/or hollows (4), while each such undercarriage (2) has, located on the top surface thereof, corresponding centering projections (3) and/or hollows (4) to rectify the containers (5; 6; 7; 8);

wherein said containers (5; 6; 7; 8) are each further equipped with an upper interconnecting contact (9) and a lower interconnecting contact (10), and the upper interconnecting contact (9) of each container is also connected to a follower unit (11), said follower unit placed under said undercarriage (2);

wherein each of said containers (5; 6; 7; 8) is further equipped with an identification unit (12) having an input (13) for a contact unit (14), and each of said identification units (12) is connected to a line between the upper (9) and the lower (10) interconnecting contacts respectively, of said container; and wherein said follower units (11) are connected to a control unit (16) by means of a data line (15).

2. The device of claim 1, wherein each undercarriage (2) is equipped with its own drive (26).

3. The device of claim 1, wherein said centering projections (3) are of a conical shape.

4. The device of claim 1, wherein said coin containers (5), or bank containers (6), are equipped with shoulders to be gripped by the fork of a high lift truck.

5. The device of claims 1, wherein said shelf racks (7), or shelf boxes (8), are equipped with shoulders to be gripped by the fork of a high lift truck.

6. The device of claim 4, wherein said coin containers (5) or bank containers (6) thereof further comprise:

a frame (17) of angle iron covered with a case (18) of sheet metal, a front door (19), and an upper door (20); and a joint control, itself comprising at least one lever (21) that is rotationally positioned on a front door (19) pin (12), wherein the end point (23) of the arm of such lever (21) is capable of both passing through an opening (24) in said frame (17), and engaging jointly with a blocking mechanism (25) of said upper door (20).

7. The device of claim 1, wherein said follower unit (11) comprises a single chip microcomputer, said identification unit (12) comprises a transponder with programmable memory, and said control unit (16) comprises a PC.

8. A device for storing objects that comprises containers that are placed on one another and that may be adjustably rearranged, wherein each said container is equipped with an upper interconnecting contact (9), and a lower interconnecting contact (10), and wherein each of said containers is further equipped with an identification unit (12) having an input (13) for a contact unit (14), and each of said identification units (12) is connected to a line between the upper (9) and the lower (10) interconnecting contacts respectively, of said containers, and wherein said contact unit (14) is connected to a control unit (16) by means of a data line (15), such that the location of any container in said device my be determined at any time by monitoring the identification data transmitted to said control unit (16) by the identification units (12), and wherein said containers are stacked on moveable undercarriages (2) that may by adjustably rearranged on rails (1) in a vault, wherein the identification data transmitted to said control unit (16) include, for each said container, a container number, the value and/or identity of property therein, names and/or passwords of persons having carried out the last handling of contents, and the time and date of said last handling.

9. The device of claim 8, wherein each of the identification units (12) comprises a transponder and a programmable memory for storing the identification data.

10. A device for storing objects that comprises containers that are placed on one another and that may be adjustably rearranged, wherein each said container is equipped with an upper interconnecting contact (9), and a lower interconnecting contact (10), and wherein each of said containers is further equipped with an identification unit (12) having an input (13) for a contact unit (14), and each of said identification units (12) is connected to a line between the upper (9) and the lower (10) interconnecting contacts respectively, of said containers, and wherein said contact unit (14) is connected to a control unit (16) by means of a data line (15), such that the location of any container in said device may be determined at any time by monitoring identification data transmitted to said control unit (16) by the identification units (12), and wherein said containers are stacked on moveable undercarriages (2) that may be adjustably rearranged on rails (1) in a vault.

11. A device for storing objects according to claim 10 wherein the identification data transmitted to said control unit (16) includes, for each said container, one or more items selected from a container number, the value and/or identity of property therein, names and/or passwords of persons having carried out the last handling of contents, and the time and date of said last handling.

* * * * *